US010801706B2

(12) United States Patent
Gielen et al.

(10) Patent No.: US 10,801,706 B2
(45) Date of Patent: Oct. 13, 2020

(54) CEILING INTERFACE FOR LUMINAIRES

(71) Applicant: SIGNIFY HOLDING B.V., Eindhoven (NL)

(72) Inventors: Vincent Stefan David Gielen, Eindhoven (NL); Rick Gerhardus Nijkamp, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/614,833

(22) PCT Filed: May 15, 2018

(86) PCT No.: PCT/EP2018/062449
§ 371 (c)(1),
(2) Date: Nov. 19, 2019

(87) PCT Pub. No.: WO2018/215235
PCT Pub. Date: Nov. 29, 2018

(65) Prior Publication Data

US 2020/0088388 A1 Mar. 19, 2020

(30) Foreign Application Priority Data

May 22, 2017 (EP) ..... 17172192

(51) Int. Cl.
*F21S 8/02* (2006.01)
*F21V 21/04* (2006.01)

(52) U.S. Cl.
CPC ..... *F21V 21/044* (2013.01); *F21S 8/026* (2013.01)

(58) Field of Classification Search
CPC ... F21S 8/043; F21S 8/026; F21S 8/06; F21V 21/044
See application file for complete search history.

(56) References Cited

U.S. PATENT DOCUMENTS

| | | | | |
|---|---|---|---|---|
| 7,896,529 | B2 * | 3/2011 | Wronski | F21S 8/02 362/365 |
| 9,970,634 | B1 * | 5/2018 | Wronski | F21V 21/041 |
| 2007/0211457 | A1 | 9/2007 | Mayfield et al. | |
| 2010/0085765 | A1 | 4/2010 | Wang | |
| 2012/0182747 | A1 * | 7/2012 | Doubek | F21V 17/164 362/390 |

(Continued)

FOREIGN PATENT DOCUMENTS

| | | | |
|---|---|---|---|
| DE | 102014205901 | A1 | 10/2015 |
| EP | 0947765 | B1 | 10/1999 |

(Continued)

*Primary Examiner* — Anabel Ton
(74) *Attorney, Agent, or Firm* — Daniel J. Piotrowski

(57) ABSTRACT

The invention provides a fixture element (1) for mounting a luminaire (10) at least partly in an opening (510) of a ceiling (500), wherein the fixture element (1) comprises (i) a body (100), (ii) a first side portion (155) protruding relative to the body (100) at a first side (150) of the body (100) and configured to support the luminaire (10), (iii) a second side portion (165) protruding relative to the body (100) at a second side (160) of the body (100), and (iv) an engagement element (200) resiliently connected to the second side (160) of the body (100) and configured to clamp a part of the ceiling (500) between the engagement element (200) and the second side portion (165).

14 Claims, 5 Drawing Sheets

(56) References Cited

U.S. PATENT DOCUMENTS

| | | | | |
|---|---|---|---|---|
| 2013/0128558 | A1 | 5/2013 | Risley et al. | |
| 2015/0078012 | A1 | 3/2015 | Delano | |
| 2017/0009963 | A1* | 1/2017 | Germain | F21V 21/042 |
| 2019/0338925 | A1* | 11/2019 | Green | F21V 17/002 |

FOREIGN PATENT DOCUMENTS

| | | | |
|---|---|---|---|
| EP | 2314909 | A1 | 4/2011 |
| GB | 2463796 | A | 3/2010 |
| GB | 2480540 | A | 11/2011 |

* cited by examiner

CEILING INTERFACE FOR LUMINAIRES

CROSS-REFERENCE TO PRIOR APPLICATIONS

This application is the U.S. National Phase application under 35 U.S.C. § 371 of International Application No. PCT/EP2018/062449, filed on May 15, 2018, which claims the benefit of European Patent Application No. 17172192.1, filed on May 22, 2017. These applications are hereby incorporated by reference herein.

FIELD OF THE INVENTION

The invention relates to a mounting system, especially a fixture element, and a kit of parts for mounting a luminaire in a ceiling. The invention further relates to a method for mounting a luminaire at (or in) a ceiling.

BACKGROUND OF THE INVENTION

Systems for mounting luminaires are known in the art. US 2013/0128558, for instance, describes amongst others a lighting fixture that includes a housing formed from walls that are connected by corner posts that are inserted into the ends of the walls and eliminate light leaks and external fasteners. The corner posts include barbs or screw holes for receiving screws from the inside of the walls. The housing can be used as a retrofit for a recessed lighting fixture where the housing can surround the lighting fixture and attach thereto. The assembly can then be mounted by a suitable support.

SUMMARY OF THE INVENTION

The major part of in-door lighting solutions has an interface with a ceiling. Because many ceiling systems are standardized, also many of the lighting solutions such as luminaires are especially developed and designed conform the ceiling they are mounted in (or at). It is rather common that in public buildings, utility buildings, offices, and shops, but also in residential buildings, a false ceiling (also known as "dropped ceiling" or "suspended ceiling" or "suspension ceiling" or "recessed ceiling") is installed at a lower level than the fixed building construction (structural ceiling). This way a plenum space (or "plenum") is formed between the structural ceiling and the false ceiling. In general these false ceilings are used to hide installation and building structure details like cables, tubes, (air) ducts, etc. (in the plenum space) and/or to improve acoustic, climate, and esthetic conditions of the room. Examples of these false ceilings comprise suspension systems for a grid and tiles, and a ceiling comprising gypsum/plaster. Many of these systems are standardized. Hence, also many standardized mounting systems for lighting elements are known. Most common ceiling systems e.g. comprise (mineral) ceiling tiles supported by profiles, such as visible T-bars or less frequently concealed T-bars, or a band raster. In such systems, the tiles mostly have a rectangular, especially a square shape. Yet, also other types of shapes (of tiles and consequently of the grid) may be possible. Further ceiling systems may be built on the spot by using combinations of wood/gypsum and plaster, especially wherein a frame may be installed from wood and the ceiling may comprise plastered (gypsum/plaster) board. This kind of ceiling may provide a more luxurious appearance because no further grid is shown. This kind of ceiling may also have the advantage that a position for mounting a luminaire is more flexible because no grid is present, but also because no suspension hooks are present in the plenum (space) that could hamper the installation of a luminaire at a specific position.

During the construction of the ceiling, lighting elements may rather easily be introduced in or at the ceiling. In a grid structure, e.g. comprising T-bars a luminaire or any utility means/application like an air supply or a ventilation tile, instead of a (ceiling) tile may be laid in. Also a mounting system for a luminaire may be installed during building a plaster ceiling. However, further changes in the lighting solutions, like installing additional luminaires or replacing luminaires, may be hard to perform.

Problems with solutions may e.g. be that installed ceiling luminaires require access from the top side when the luminaires need to be serviced, or replaced, which presently renders said replacement and/or servicing cumbersome. Installing additional luminaires in a plaster ceiling may require providing an opening in the ceiling and successively constructing a mounting system for the luminaire at the ceiling. Known mounting systems are (to be) constructed at the top side of the ceiling (in the plenum space) and require space to operate, but also the ability to reach the top side of the ceiling.

Hence, it is an aspect of the invention to provide an alternative mounting system, especially a fixture element and a kit of parts for mounting a luminaire in a ceiling which preferably further at least partly obviate(s) one or more of above-described drawbacks. It is a further aspect to provide a method for mounting a luminaire at (or in) a ceiling and luminaire per se. Yet in a further aspect, the invention provides a lighting system comprising a luminaire mounted in a ceiling that preferably at least partly obviates one or more of the above-described drawbacks.

The present invention may have as object to overcome or ameliorate at least one of the disadvantages of the prior art, or to provide a useful alternative. The mounting system especially comprises a fixture element that may be attached to a ceiling in an opening in the ceiling.

Therefore, in a first aspect the invention provides a fixture element for mounting a luminaire at least partly in an opening of a ceiling, especially comprising an opening wall, wherein the fixture element comprises (i) a body, (ii) a first side portion protruding relative to the body at a first side of the body and configured to support the luminaire, (iii) a second side portion protruding relative to the body at a second side of the body, and (iv) an engagement element resiliently connected to the second side of the body and configured to clamp a part of the ceiling between the engagement element and the second side portion. Especially, the fixture element is configured to clamp a part of the ceiling that is located near the opening wall.

Attaching or mounting the fixture element to the ceiling may not require (the more elaborate) installing from the top side of the ceiling. The fixture element is especially configured allowing it to be secured (from below the ceiling) over the ceiling at the location of the opening in the ceiling. Such fixture element may simply be slid around an edge of ceiling, especially comprising the opening wall, and may secure itself at the ceiling. When the fixture element is installed, a first part may be arranged below the ceiling whereas especially a major part of the fixture element is arranged above the ceiling. The fixture element may be secured at the ceiling by an engagement element that holds a part of the ceiling that is enclosed between the engagement element and the part of the fixture element arranged below the ceiling (see further below). Hence, with the present invention relatively easily a luminaire may be installed in practically any ceiling (having an open space above the ceiling). With such fixture element, it appears to be possible to mount or install a luminaire in an opening of the ceiling substantially without performing complex handling on top of the ceiling. Almost any standard type of luminaire and comprising, or provided with, a mounting plate (see further below) corresponding with the fixture element may be mounted in the opening. Moreover, with the fixture element a luminaire with any arbitrarily size or type may be mounted by providing an opening in the ceiling that corresponds to the size/type of the luminaire, in contrast to prior art solutions wherein each size/type of luminaire requires its specific or tailor made frame to be installed at the opening. With such element the luminaire may be ceiling mounted and/or may be flush mounted. Hence, the invention provides a large degree of flexibility in selecting the luminaire.

Such element may provide flexibility in installing lighting solutions, especially in plastered ceilings. Such fixture element may comprise a determined structure to support a luminaire. Such element may e.g. comprise a profile, such as a T-bar (see further below), and may allow to provide a T-bar (or other standard—modular—profile) structure at a plaster ceiling. Such T-bar may then hold a luminaire. Such fixture element may also comprise a snap-in structure to snap in a luminaire. Yet, such structure may (also) comprise a structure allowing receiving a luminaire by twisting or translating for engaging the fixture element (see further below).

The terms "top", "below", "bottom" and the like such as in "at the top side of the ceiling", "below the ceiling", at the "bottom side of the ceiling", etc. used herein will be understood and especially relate to relative positions with respect to the normal use of a ceiling and a luminaire installed in or at a ceiling. Hence, the top side of the ceiling may be the side of the ceiling arranged in (or facing) the plenum (space). Especially, for a horizontally installed (dropped) ceiling a line from the top of the ceiling to below the ceiling may coincide with the direction of the gravitational force. In a slanting ceiling, these directions may however form an angle. A position below the ceiling, especially relates to a position opposite to the plenum space, irrespective of the configuration of the ceiling (i.e. horizontal or slanted). The terms "plenum space" and "plenum" especially relates to the space between a (dropped or false) ceiling described herein and a fixed building construction, especially a structural ceiling.

Therefore, in embodiments the luminaire may be configured such that the light emitting surface or luminaire window is essentially at the same level of the ceiling. The luminaire may also be configured partly protruding from the ceiling. The luminaire may also be configured recessed.

The ceiling may especially be a suspension ceiling or suspension system, like a recessed ceiling. The ceiling is especially a ceiling with behind the ceiling a plenum.

The luminaire may thus be configured in essentially any space with a (recessed) ceiling, such as an office, a department store, a warehouse, a cinema, a church, a theatre, a library, etc. The term "space" may (thus) also relate to (a part of) a working space, such as an office, a (production) plant, a power, etc. For instance, the term "space" may also relate to a control room, a security room, etc.

Essentially, the fixture element comprises an engagement element configured to (autonomously) (press and) hold a part of the ceiling between the second side portion and the engagement element. Hence, (vice versa) the fixture element is configured to clamp and hold itself at the ceiling. Especially, the engagement element does not need to be fastened (in the ceiling) by means of fasteners, or bolds and the like to physically contact the ceiling, especially to act (apply a force) on the ceiling. Especially, the engagement element may provide a force acting (among others) upon the second side portion, especially pulling the second side portion towards and against the ceiling. Essentially, the engagement means may be resiliently connected to the (second side of) the body. In embodiments, the engagement element may e.g. be pivotably connected to the body. In further embodiments, the engagement element comprises a spring, especially a leaf spring connected to the body. Yet in further embodiments, the engagement element comprises a flexible resilient material connected to the body, such as a plastic or a metal material. Especially, the engagement element comprises a spring-loaded engagement element. Such element may pivot about a location where the engagement element is connected to the body. A load of the spring loaded element may be the result of a thickness of a spring or a type of the resilient (spring) material. Hence, the load may be configurable. Such load may be selected based on a weight of the luminaire, the ease of mounting the fixture element to the ceiling, and e.g., a height of the opening wall. Such element may (also) comprise a shape as a function of a force acted upon the element. Hence, a position of the engagement element relative to the second side portion and/or the shape of the engagement element may be adapted based on a force acting on the engagement element.

Herein the term "an engagement element" may also relate to more than one (different) engagement element. Likewise, the terms "a first side portion" and "a second side portion" may also relate to respectively more than one (different) first and second side portion.

The fixture element may be clamped over the ceiling by moving a part of the fixture element over the opening wall, wherein the second side portion is arranged below the ceiling and especially wherein the part comprising the engagement element is arranged on top of the ceiling.

For mounting a luminaire at least partly in the opening of the ceiling a fixture element may be attached to the ceiling and successively the luminaire may be engaged with the fixture element. Especially, the luminaire is engaged with (at least) two fixture elements attached to the ceiling.

The opening (in the ceiling) may comprise a rectangular, especially a square, opening comprising a width and a length of the opening (edge). The opening may especially be configured to host the luminaire.

In embodiments, e.g. the fixture element comprises a T-bar profile and two fixture elements are attached to the ceiling, especially at opposite edges of the opening. Successively a, especially rectangular, luminaire may be laid in the two fixture elements and being supported by (the first side portion of) the fixture elements. It may be advantageous to support at least two edges of the luminaire over a part of the length of the edges of the luminaire, even more especially substantially the entire length of the edges of the luminaire. Hence, in embodiments the fixture element, especially the first side portion, comprises a length configured to support a length (or a width) of an edge of a luminaire. The first side portion may be selected to comprise a length (or a width) of the opening (edge). In embodiments, two of such fixture elements are attached to the ceiling at two opposite edged of the opening. In embodiments, the length of the fixture element substantially corresponds to a length of a side of the opening (wall). In further embodiments, two fixture elements comprising a triangular shape, especially comprising two straight sides of a triangle (see below) are attached to the ceiling in two opposite corners of the opening. Especially, the two latter fixture elements may provide a T-bar structure substantially over the entire perimeter of the opening.

Herein the term "T-bar" such as used in "T-bar structure" especially relates to a profile known from modular ceiling systems, comprising a T-shape that is configured upside down, comprising a base strip with in the middle an upright strip, to support e.g. a ceiling tile at both sides of the up-right strip. A fixture element comprising a T-bar especially relates to a fixture element wherein the first side portion and the second side portion are configured at the same level, in line with each other, and especially wherein the first side portion and the second side portion comprise a straight and especially flat side portion. Hence, in embodiments, the second side portion comprises a flat side portion. In further embodiments, the first side portion (also) comprises a flat first side portion configured to support the luminaire. Especially, the first side portion and the second side portion are configured in line with each other, especially providing one undivided flat strip.

After attaching the fixture element to the ceiling it may be appreciated substantially not to obstruct the opening with the fixture element (allowing mounting the luminaire in/over substantially the entire opening). Therefore, the fixture element is especially configured to contact the opening wall (when it is mounted at the ceiling). Hence, in embodiments, the fixture element comprises a shape configured to mate a part of a shape of the opening, especially a part of a shape of the opening wall of the opening in the ceiling, such as wherein the fixture comprises an angle and/or a curved part corresponding to an angle and/or curved of the opening (wall of the opening) wherein the luminaire is to be configured.

In embodiments, the opening comprises a circular opening, and especially the fixture element comprises arc shape. In other embodiments, the opening (wall) comprises a rectangular (including in embodiments square) shape. For such rectangular shape the fixture element, especially the body, may comprise a planar shape, especially not to obstruct the opening to a large extend. For a rectangular (or square) shaped opening (comprising four corners with a right angle), the fixture element may further comprise an L-shape or triangular shape (especially comprising only the straight sides of a triangle) to mate (fit in) a corner of the opening. Yet, in further embodiments, the opening may comprise one or more acute or obtuse angles. The opening (wall) may e.g. one or more corners having an angle of about 120°. Especially, in such opening a fixture element comprising a shape comprising an angle of about 120° may be mounted in one or more of these corners. Hence, the body may comprise two (planar) segments, especially a first (planar) segment and a second (planar) segment. In embodiments, the first (planar) segment and the second (planar) segment are configured in line with each other. The first segment and the second segment may (also) be configured at a segment angle selected in the range of 30-150°, such as 60-120°. In further embodiments, the segment angle is selected in the range of 80-100°. The segment angle may also be selected to be about 90°. In a further embodiment, the segment angle is a (substantially) right angle. In embodiments the second side portion is configured to only cover a small part of the edge of the opening (wall) (after attaching the fixture element to the ceiling). In other embodiments, the second side portion is configured to cover about half of the edge of the opening (after attaching the fixture element to the ceiling). Especially, by attaching two of said fixture elements (at opposite corners of the opening) substantially the entire edge of the opening may be covered by the second side portion of the two fixture elements.

The fixture element may comprise more than one (different) engagement element. Each (planar) segment of the fixture element may comprise at least one engagement element. In embodiments, the body comprises a first segment comprising a first engagement element (connected to the first segment, especially resiliently connected to the second side of the body) and a second segment comprising a second engagement element (connected to the second segment, especially resiliently connected to the second side of the body). In further embodiments, the fixture element comprises at least two engagement elements, wherein the body comprises a first planar segment and a second planar segment, especially wherein the first segment and the second segment are configured at a segment angle selected in the range of 60-120°, and especially wherein a first engagement element is connected to the first segment and a second engagement element is connected to the second segment.

Hence, in embodiments, the fixture element comprises a plurality of engagement elements. In an embodiment, the fixture element comprises two engagement elements, especially wherein one engagement element is connected to a first segment and another engagement element is connected to a second segment.

The fixture element, especially the first side portion, is especially configured to support a luminaire. Herein the term "supporting" as in "supporting the luminaire" may relate to preventing the luminaire from falling down. Supporting may further comprise holding the luminaire by connecting the luminaire to the fixture element. In embodiments, the fixture element is configured to be connected to the luminaire. Especially, the luminaire may comprise a mounting plate and the fixture element may comprise a (first) connector element configured to engage with (a (second) connector element of) the mounting plate. Especially, the first side portion comprises a (first) connector element. In embodiments, the mounting plate comprises a second connector element. Thus the risk on the luminaire unintentionally falling down is reduced, an hence a more secure/safe mounting of the luminaire in the opening of the ceiling is obtained.

Such connection/engagement between the luminaire (especially the second connector element) and the fixture element (especially the first connector element) may comprise different type of configurations. Such connection may e.g. comprise a snap-fit configuration, especially wherein (the second connector element of) the mounting plate and (the first connector element of) the fixture element may be pushed together to interlock (to snap one of the connector elements in the other connector element). In embodiments, such connection may comprise a kind of bayonet configuration, especially comprising a pin to be twisted in an L-type slot to interlock. Yet in further embodiments, connecting may comprise a combination between pushing and twisting. Hence, the connection may comprise a male-female configuration. Especially a male or a female connector element is configured at the fixture element and a corresponding female or male connector element is configured at the luminaire, especially at the mounting plate of the luminaire. Hence, the first connector element may comprise a male or a female connector element, and especially the second connector element comprises a (corresponding) female or male connector element. In embodiments, such male and/or female connector comprises a rigid connector, especially to ease connecting. In further embodiments at least one of the male and female connector is configured flexible, e.g. allowing a small deformation during connecting. Hence, in embodiments, the fixture element, especially the first side portion comprises a flexible material, especially a plastic material. In further embodiments, the body comprises a plastic, (e.g. polycarbonate (PC), acrylonitrile butadiene styrene (ABS), polybutylene terephthalate (PBT)) material. Especially the body may consist of a plastic material. Herein, the term "flexible" especially relates to allowing a substantially reversible deformation. Hence, the fixture element and/or the mounting plate may comprise a flexible material, especial a plastic material. Especially the flexible material may deform and successively return to its original shape.

Hence, in embodiments, the first side portion comprises a first connector element for engaging a second connector element of a mounting plate comprised by the luminaire, especially thereby supporting the luminaire. In embodiments, the first connector element comprises a groove, and especially the second connector element comprises a (mounting) ridge (configured to engage the groove), especially (configured) for a male-female connection. In further embodiments, the first connector element comprises a (fixture element) ridge and especially the second connector element comprises a groove, especially (configured) for a male-female connection. In yet further embodiments, the first connector element comprises a (fixture element) ridge with a groove configured between the body and the (fixture element) ridge, especially wherein the second connector element may comprise a (mounting) ridge, especially (configured) for a male-female connection. In embodiments the first connector element comprises a slot and especially the second connector element comprises a pin (configured to engage said slot). Hence, in a specific embodiment the first connector element and the second connector element are configured for providing a connection between the luminaire and the ceiling, such as via a male-female connection.

In embodiments, the mounting and/or the fixture element ridge, especially the mounting ridge and the fixture ridge, comprise a rounded tip. Such rounded tip may facilitate engaging (connecting) the first and second connector element (mutually), especially by a snap-fit configuration. A ridge may comprise an angle at a tip of the ridge. Especially, such angle comprises an acute angle. Yet in other embodiments, such angle (of one or more of the mounting ridge and the fixture ridge) comprises an obtuse angle. A mounting ridge and a fixture ridge may slide over each other (to mutually engage the connector elements and especially to provide the male-female connection) by contacting the two ridges with each other and successively moving one of the ridges with respect to the other, especially by a rotational movement or a small twist (see also below). For providing afore mentioned male-female connection, especially at least one of the fixture ridge angle and the mounting angle comprises an acute angle. Especially, (also) the first connector element comprises the fixture element ridge with a groove configured between the body and the fixture element ridge.

To obtain a firm connection between the fixture element and the luminaire, and especially to provide a mounting of the luminaire wherein substantially the entire opening is covered by the luminaire and/or the fixture elements it may be required to engage the second connector element(s) with the first connector element(s) by only minimally moving the luminaire. Hence, the first connector element and the second connector element may be configured to engage when the first and second connector element are moved over a small distance relative to each other, such as over a distance of 0.5-10 mm, such as 0.5-5 mm, especially 0.5-3 mm. In further embodiments, the said relative distance may be selected in the range of 1-6 cm, especially 1-3 cm. A maximum (practical) distance may be the result of a final clearance between the luminaire and the opening, especially between the luminaire and the body of the fixture elements, after having mounted the luminaire. A maximum distance may also be the result of the type of relative motion (e.g. translation or rotation). A maximum distance may further be the result of a size of the connector elements and especially of the movability and/or flexibility of the fixture element (as such and also relative to the ceiling). In embodiments, e.g. the first connector element may move relatively to the ceiling (especially in a direction opposite to the plenum space) when the second connector element engages the first contactor element. Such movement may be provided by the resilient connected engagement element. Such movement may further by the result of the configuration of the first connector element and the second connector element. The (absolute) distance may further depend on a size of the opening and on a shape of the opening. In embodiments, the luminaire may be mounted in an opening by contacting a second connector element (especially two second connector elements) with a first connector element (especially two first connector elements) of a (especially two) fixture elements attached to the ceiling and twisting the luminaire over a relatively small twisting angle to provide the male-female connection. Such twisting angle may be selected in the range of 0.5-5°, such as 0.5-2.5°, especially 0.5-1.5°. This method may advantageously be applied for a first connector element comprising a fixture ridge and a groove and especially wherein the second connector element comprises a mounting ridge. To facilitate the movement of each mounting ridge over a respective fixture element ridge into the groove of the respective fixture element, one or more of the ridges may comprise a guiding angle. Further, a length of the first connector element and/or second connector element may be selected to provide the male-female connection by twisting over such a small twist angle. Especially, a ridge length, especially determined along a rotational direction of said twist, of the fixture element ridge and/or of the mounting ridge is selected to be equal to or less than 5% of a length of an edge of the opening (wall) ("edge length", such as a width or a length of the opening edge). Especially, a ratio of said ridge length over said edge length is equal to or less than 0.05, especially equal to or less than 0.03, such as selected in the range of 0.01-0.025. The length may further be determined by the weight of the luminaire, and the material properties, i.e. yield strength, of the suspension. In embodiments, the weight of the luminaire may be multiplied by five time g, for safety reasons. Hence in embodiments comprising an edge length of 60 cm, the ridge length is selected in the range of 0.6-3 cm.

Hence, the invention also provides in a further aspect a luminaire comprising a mounting plate, especially wherein the mounting plate is configured to engage with a fixture element described herein. Especially, the luminaire may comprise at least a plurality of mounting plates, such as two mounting plates. The mounting plate(s) may be part of the luminaire. The mounting plate may be configured to be (fixedly) connected to the luminaire. In embodiments, the mounting plate may be connected to the luminaire by a fastening element, such as a fastener, a screw, a snap-in fastening element, etc., without negatively affecting the functionality of the mounting plate and the luminaire. Such mounting plate may comprise a second connector element configured to engage a first connector element of a fixture element. Herein the term "fastening element" may (also) relate to more than one (different) fastening elements.

In embodiments, a (rectangular, especially square) luminaire may comprise (at least) a plurality of mounting plates, such as two mounting plates, associated at a first side of the luminaire, wherein the mounting plates especially are configured at opposite corners of the luminaire. Said first side of the luminaire especially being arranged opposite to a (second) side of the luminaire configured to provide light, especially opposite to the side comprising the light emitting surface or luminaire window. Such luminaire may be mounted in a (rectangular, especially square) opening of the ceiling, wherein (at least) two fixture elements are provided (mounted) to the ceiling (as described above), especially at two opposite corners of the opening. Successively mounting the luminaire may comprise engaging the second connector elements of the mounting plates with corresponding first connector elements of the fixture elements. Mounting one luminaire thus, may require (at least) two fixture elements and a luminaire comprising (at least) two (corresponding) mounting plates.

Hence, in a further aspect, the invention also provides a kit of parts comprising a plurality, such as a pair, of fixture elements according to the invention and a plurality, such as a pair, of mounting plates for a luminaire, wherein each mounting plate comprises a second connector element configured to engage a first connector element of the fixture element, (wherein the first side portion of each fixture element comprises said first connector element,) wherein each mounting plate is configured to (fixedly) connect the mounting plate to the luminaire, especially wherein one or more of the fixture elements and the mounting plates comprise a flexible material. Each mounting plate may further comprise a fastening element to connect the mounting plate to the luminaire.

In an embodiment, (a) the first connector element(s) comprise(s) a groove and the second connector element(s) comprise(s) a mounting ridge or (b) the first connector element(s) comprise(s) a mounting ridge and the second connector element(s) comprise(s) a groove, (configured) for a male-female connection. In a further embodiment the fixture elements and/or the mounting plates comprise a plastic material.

In an embodiment, the first connector element of each fixture element comprises a (fixture element) ridge, with a groove configured between the body and the (fixture element) ridge, wherein the second connector element of each mounting plate (also) comprises a (mounting) ridge. A ridge may comprise a tip, especially a rounded tip. In further embodiments the tip comprises an angle. Especially, each fixture element ridge comprises a fixture ridge angle (at a tip of the fixture ridge) and especially each mounting ridge comprises a mounting ridge angle (at a tip of the mounting ridge). In embodiments at least one of the fixture ridge angle and the mounting ridge angle comprises an acute angle. In further embodiments, both the fixture ridge angle and the mounting ridge angle comprise an acute angle. In further embodiments at least one of the (fixture element and mounting) ridges comprises a rounded tip. Yet, in other embodiments, each fixture element and each mounting ridge element comprises a rounded tip.

In yet a further aspect, the invention provides a method for mounting a luminaire at (and/or in) a ceiling, wherein the method comprises: (i) providing an opening with an opening wall in the ceiling; (ii) providing at least two fixture elements as described herein to the ceiling by arranging a part of the ceiling between the engagement element and the second side portion; and (iii) a mounting stage, wherein the mounting stage comprises configuring the luminaire at least partly in the opening of the ceiling, wherein the luminaire is supported by the first side portions.

In embodiments the luminaire may be transferred upwards through the opening (into the plenum space) (and optionally rotated etc. in the plenum space) and successively be transferred downwards again and be configured (at least partly) in the opening. In an embodiment the mounting stage (further) comprises laying the luminaire at the second side portion of each fixture element.

In embodiments, the fixture elements are provided (to the ceiling) at (at least) two opposite corners of the opening. In embodiments (wherein the luminaire comprises a plurality of mounting plates, especially at least two, especially associated to a first side of the luminaire, and especially wherein the mounting plates are connected at two opposite edges of the first side of the luminaire), the mounting stage (further) comprises configuring the first side portions (of the fixture elements) and the mounting plates in a male-female configuration for support of the mounting plates by the first side portions.

In embodiments, the mounting stage comprises contacting the second connector element of each mounting plate with the (corresponding) first connector element of one of the first side portions and twisting the luminaire over a twisting angle selected in the range of 0.5-10°, such as 0.5-5°, especially 0.5-2.5° (especially thereby engaging the said second connector element with said respective first connector element) to configure the first side portion 155 and the mounting plates (300) in a male-female configuration).

In further embodiments, the mounting stage (further) comprises engaging each second connector element, especially the mounting ridge of each mounting plate connected to the luminaire, with the (corresponding) first connector element, especially the groove of each fixture element provided to the ceiling (wherein the luminaire is supported by the first side portions). In further embodiments, engaging the mounting ridge of each mounting plate connected to the luminaire with the groove of each fixture element provided to the ceiling comprises: resting each mounting ridge against (especially contacting each mounting ridge with) a fixture element ridge of a respective fixture element and twisting the luminaire over a twisting angle selected in the range of 0.5-10°, such as 0.5-5°, especially 0.5-2.5° to transfer each mounting ridge over a respective fixture element ridge into the groove of the respective fixture element. In a further embodiment, the luminaire is functionally coupled to a power supply, especially before the mounting stage.

In a further aspect, the invention provides a space comprising a lighting system, wherein the space comprises a ceiling and a luminaire mounted in the ceiling, wherein for mounting the luminaire in the ceiling the lighting system comprises at least two fixture elements according to the invention and optionally at least two mounting plates.

Hence, in embodiments, the invention provides a lighting system comprising a luminaire mounted in a ceiling, wherein the lighting system comprises at least two fixture elements (described herein) and optionally at least two mounting plates (described herein).

Herein, the luminaire and opening are amongst others described in embodiments as having rectangular cross-sections, with the cross-section chosen such that the luminaire can at least partly be mounted in the opening. Shapes other than rectangular may also be chosen, such as round or polygonal, such as with 3, 4 (rectangular), 5, 6 (hexagonal), 7, 8 (octagonal), 9, 10 (decagonal), or even more edges. Especially, polygonals with 4, 6 or 8 edges may be applied.

When installed, in embodiments it may be possible to remove the luminaire, such as by twisting the luminaire out of the ceiling with the necessary torque.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily to scale.

DETAILED DESCRIPTION OF THE EMBODIMENTS

Figure 1A:
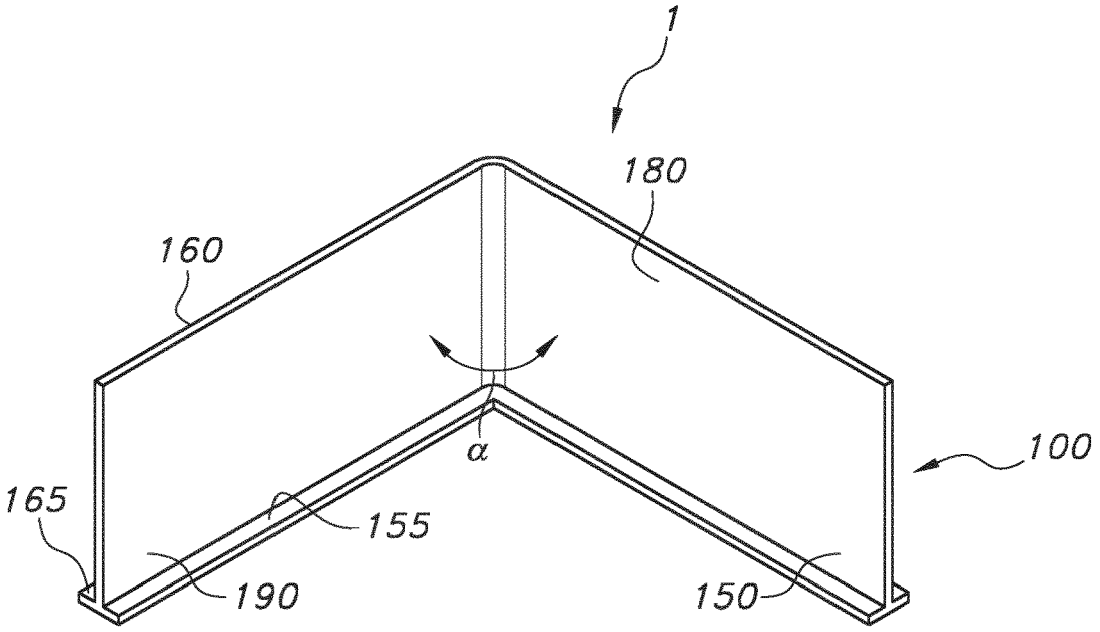
FIGS. 1*a*-1*c* schematically depict some general aspects of the fixture element.
Figure 1B:
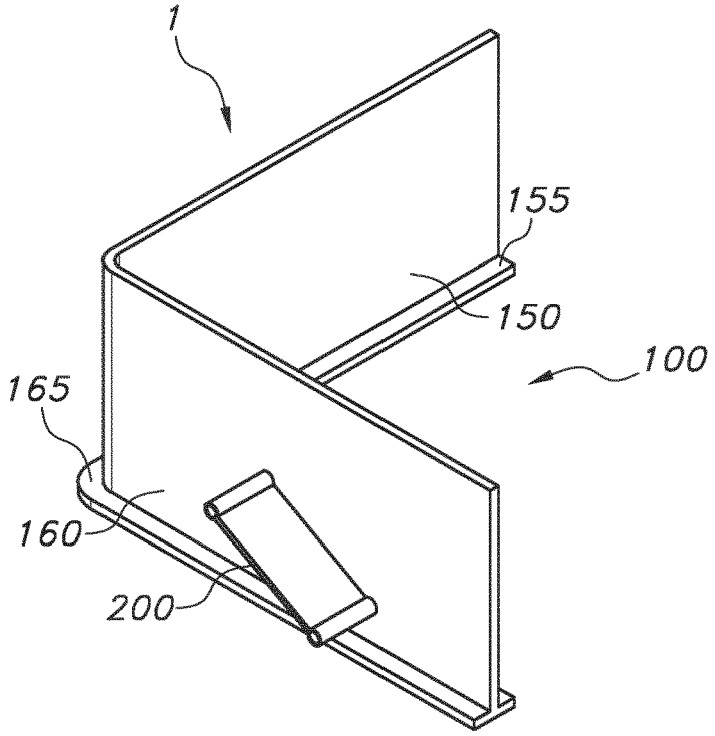
Figure 1C:
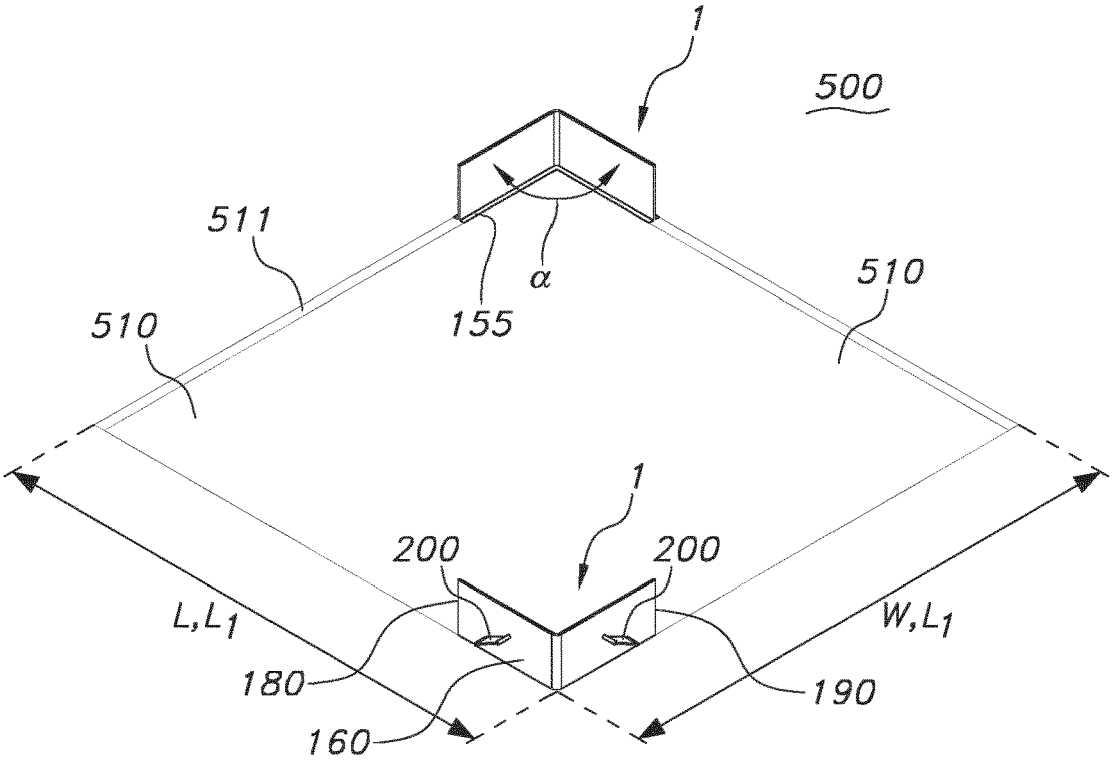

In FIGS. 1*a*-1*c* some aspects of embodiments of the fixture element 1 are schematically depicted. The fixture element 1 may be used for mounting a luminaire 10 at least partly in an opening 510 of a ceiling 500. The fixture element 1 comprises a body 100, two side portions 155, 165, and an engagement element 200. The first side portion 155 protrudes relative to the body 100 at a first side 150 of the body 100. The second side portion 165 protrudes relative to the body 100 at a second side 160 of the body 100. The engagement element 200 is resiliently connected to the second side 160 of the body 100.

Figure 3A:
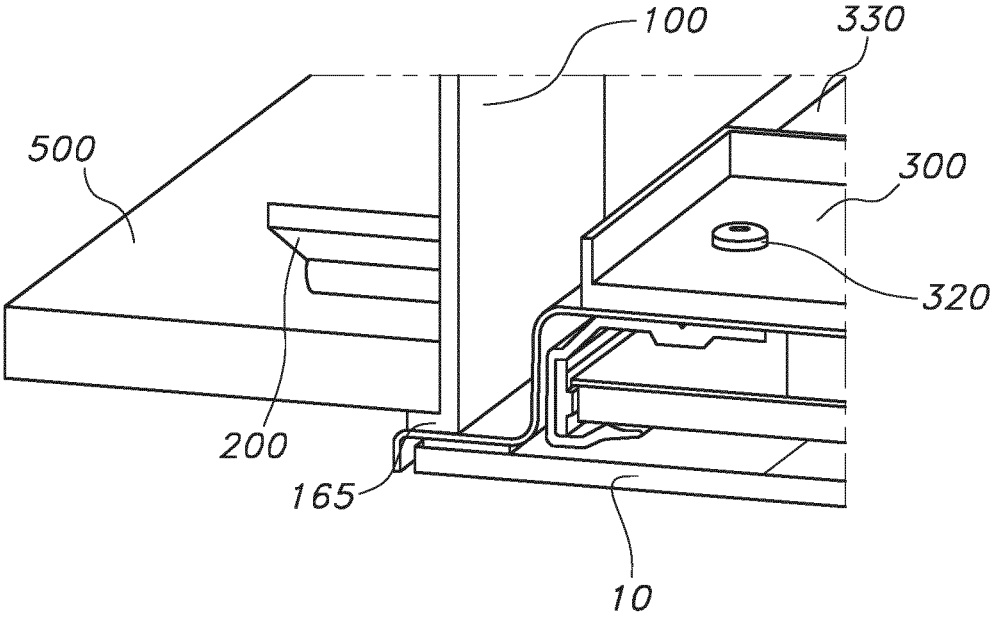
FIGS. 3*a*-3*c* schematically depict some aspects of the fixture elements and the connector elements.
Figure 3B:
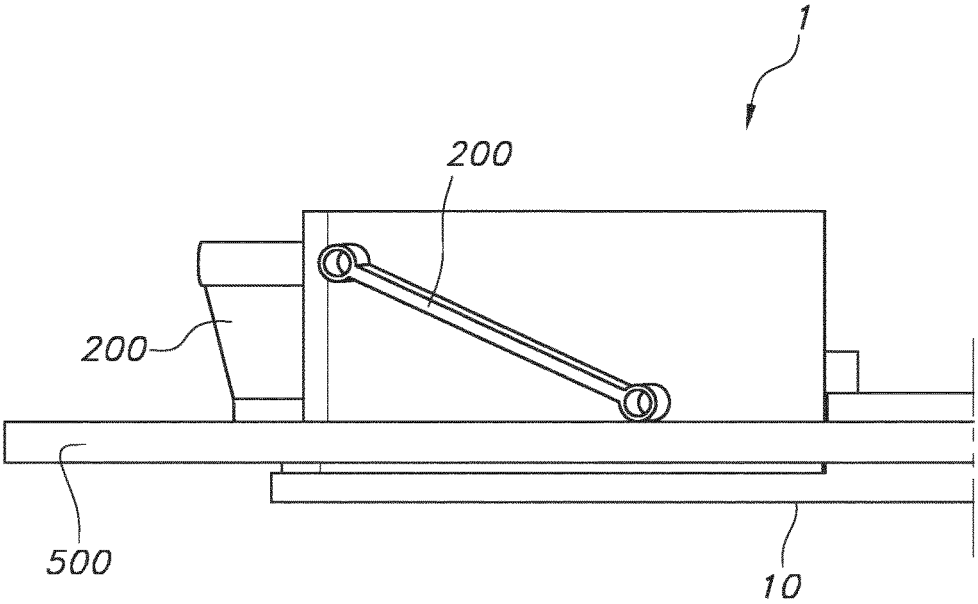

The first side portion is especially configured to support the luminaire 10. The second side portion is especially configured to contact the ceiling 500, especially to be arranged below the ceiling 500. The engagement element 200 is configured to clamp a part of the ceiling 500 between the engagement element 200 and the second side portion 165, see also FIGS. 3*a*-3*b*. For that, the engagement element 200 may comprise a spring-loaded engagement element 200. In embodiments, the fixture element 1 comprises at least two engagement elements 200. The embodiment depicted in FIG. 1*c* comprises two engagement elements 200. The embodiments depicted in FIGS. 1*a*-1*c*, further comprise two segments 180, 190, especially two planar segments 180, 190 configured at a segment angle α. Such angle may be e.g. the range of 60-120°. In FIG. 1*c* an opening 510 is depicted comprising a length l and a width w of the opening 510/of the opening wall 511. These length l and width w, may herein also be referred to as an edge length l1 (length l1 of the edge) of the opening 510/or of the opening wall 511. For an opening 510 depicted in FIG. 1*c* having a substantially square shaped edge of the opening 510, or of the opening wall 511, the angle α may be substantially 90°. Hence, in embodiments the angle α is a right angle. The fixture element 1 may especially comprise a shape configured to mate a part of a shape of an opening wall 511 of the opening 510 in the ceiling 500.

FIG. 1*c* also depicts that at first engagement element 200 is connected to the first segment 180 and a second engagement element 200 is connected to the second segment 190. The embodiment, further comprises a flat first side portion 155 configured to support the luminaire 10. The first side portion 155 not necessarily is flat, and may e.g., comprise a first connector element 110 for engaging a second connector element 310 of a mounting plate 300 comprised by the luminaire 10, as is depicted in the embodiment in FIG. 2*a*.

The body 100, and especially the first side portion 155, may be flexible to allow a reversible deformation when mutually engaging the connector elements 110, 310. In embodiments the body 100, especially the first side portion, comprises a plastic material.

Figure 2A:
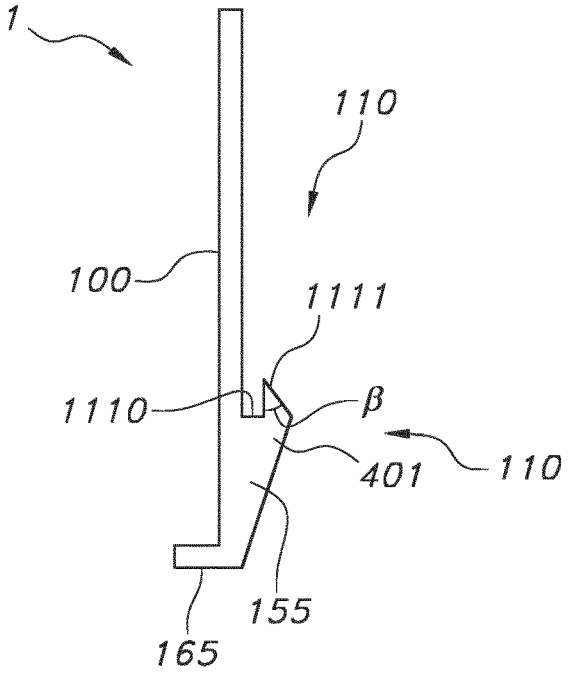
FIGS. 2*a*-2*b* schematically depict some aspects of the connector elements.

FIG. 2*a* depicts an embodiment of the first connector element 110 comprising a groove 1110, and a fixture element ridge 1111, wherein the groove 1110 is configured between the body 100 and the fixture element ridge 1111. This first connector element may be engaged (to provide a male-female connection) with a second connector element 310, e.g. the one depicted in FIG. 2*b*, comprising a mounting ridge 1310. In other embodiments, the first connector element 110 comprises a mounting ridge 1310. Such latter embodiment may be engaged with a second connector element 310 comprising a groove 1110 for a male-female connection. The second connector element 310 is especially comprises by a mounting plate 300 that is comprised by a luminaire 10 or that may be connected to a luminaire 10.

In embodiments, a luminaire is mounted in an opening 510 of a ceiling 500 by a plurality of mounting plates 300, such as two mounting plates 300, and two respective fixture elements 1. Therefore, the invention also provides a kit of parts comprising a plurality, such as a pair, of fixture elements 1 and a plurality, such as a pair, of mounting plates 300 for a luminaire 10, wherein each mounting plate 300 comprises a second connector element 310 configured to engage a first connector element 110 of the fixture element 1. Especially, each mounting 300 plate is configured connectable to the mounting plate 300 to the luminaire 10. Hence, the mounting plate 300 can be connected to the luminaire. Such luminaire 10 may be a standard luminaire 10. The mounting plate may e.g. be connected to the luminaire 10 by a fastening element 320, see FIG. 2*b*. Hence, in embodiments, the kit of parts also comprises fastening elements 320.

Figure 2B:
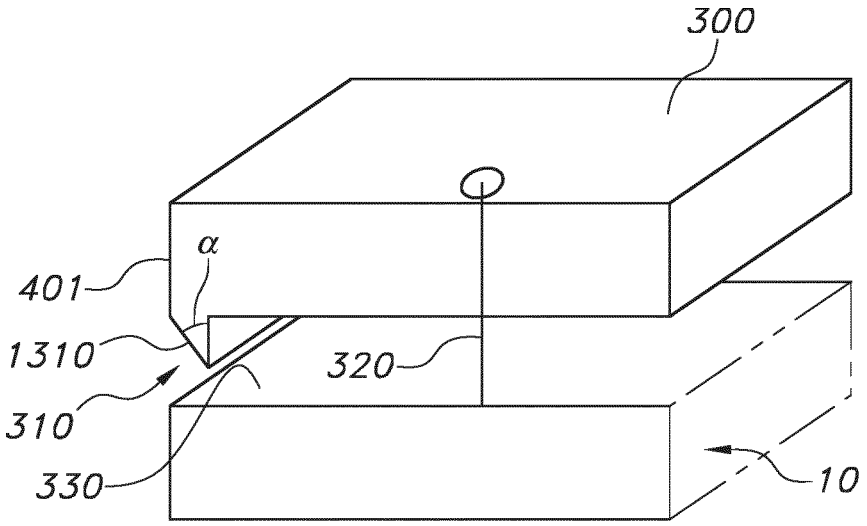

In FIGS. 2*a* and 2*b*, further the angles β, γ are depicted at the tips of the respective ridges 1111, 1310. In the given embodiments, both the fixture ridge angle β and the mounting ridge angle γ comprise an acute angle. In other embodiments, one of the angles β, γ or both angles β, γ are obtuse angles. Yet in further embodiments at least one of the fixture ridge and the mounting ridge comprise a rounded tip, see FIG. 3*c*. These different configurations for the connection may facilitate the mutual engagement of the fixture element 1 and the mounting plate 300. To further facilitate engaging a mounting plate with a fixture element, embodiments of the fixture element 1 and/or of the mounting plate 300 comprise a flexible material 401, such as a plastic material.

Figure 3C:
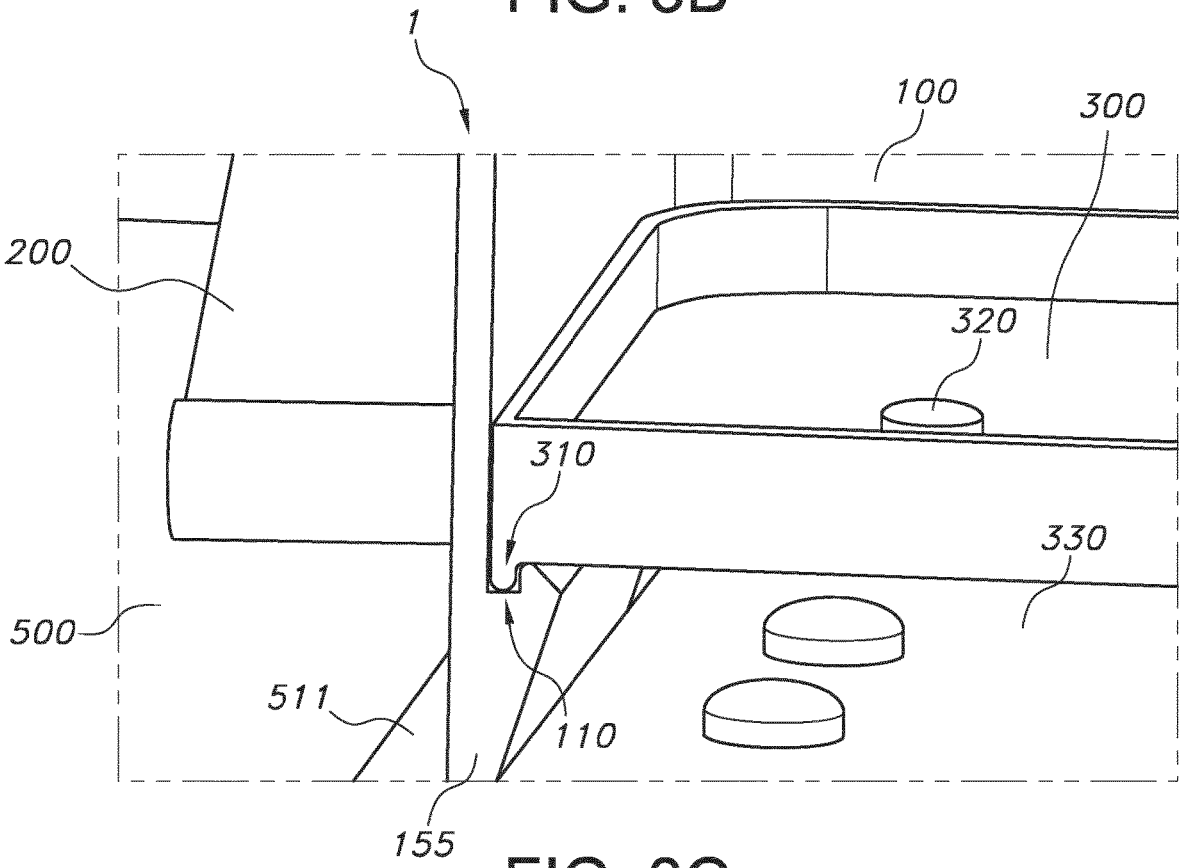

For mounting the luminaire 10 at, especially in, a ceiling 500, an opening 510 with an opening wall 511 in the ceiling 500 may be provided. Successively at least two fixture elements 1 may be provided to the ceiling 500 by arranging a part of the ceiling 500 between the engagement element 200 and the second side portion 165, see FIG. 3*a*. Next, the luminaire may be configured at least partly in the opening 510 in a mounting stage, wherein the luminaire 10 is supported by the first side portions 155. It is noted that in FIG. 3*a*, the first side portion 155 is not visible (anymore after mounting the luminaire 10 in the opening 510) because it is located behind the mounting plate 300, see however FIG. 3*c*, showing the connection in more detail. In that figure a detail is depicted of the fixture element 1 comprising the first connector element 110 that is connected to the second connector element 310 of the mounting plate 300. The fixture element 1 is mounted in the ceiling 500 by means of the engagement element 200. The mounting plate is connected to the first side 330 of the luminaire 10 by means of a fastening element 320.

Figure 4:
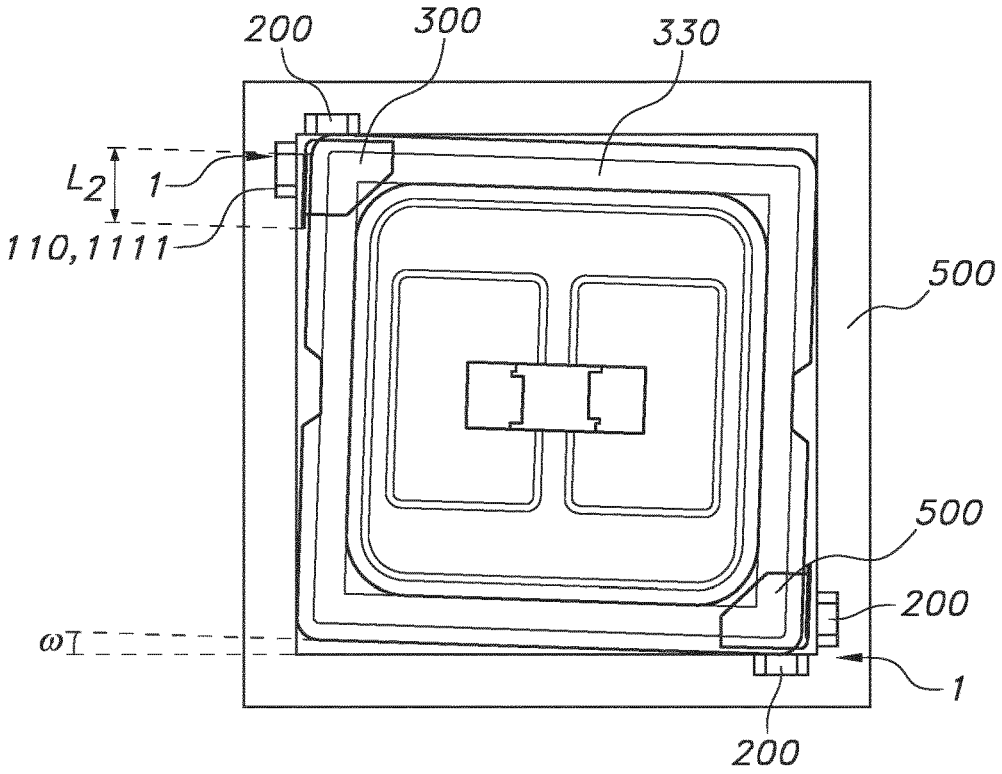
FIG. 4 schematically depicts some further aspects of the invention.

In embodiments, a plurality of mounting plates 300, here as two mounting plates 300, are associated to a first side 330 of the luminaire 10, see FIG. 4. That figure schematically depicts a luminaire 10 from the top side, showing the first side 330 of the luminaire 10. In that embodiment the mounting plates 300 are connected at two opposite edges of the first side 330 of the luminaire 10. In a mounting stage the first side portion 155 and the mounting plates 300, especially the second connector elements 310 may be configured in a male-female configuration for support of the mounting plates 300 by the first side portions 155. It is noted that again, the first side portion 155 is not visible in the schematic figure.

In the embodiment depicted in FIG. 4 the luminaire 10 may be mounted in the opening 510 by contacting (each of) the two second connector elements 310 (not visible) with a first connector element 110, especially comprising a fixture element ridge 1111 comprising a ridge length l2, of a respective fixture elements 1 attached to the ceiling 500, and twisting the luminaire 10 over a relatively small twisting angle ω to provide the male-female connection. The configuration of the fixture element 1, especially the first connector element 110, and the mounting plate 300 may require only a very small angle to engage the two connector elements 110, 310. A twisting angle ω may e.g. be selected in the range of 0.5-2.5°. A length of the first connector element 110, especially a ridge length l2, may be selected based on the width w or the length l of the opening 510, especially an edge length l1, to provide mounting with such small twisting angle ω. In embodiments a ratio of said length of the first connector element 110, especially said ridge length l2, over the edge length may be selected in the range of 0.01-0.075, especially 0.01-0.05, even more especially 0.01-0.03. In embodiments l2/l1 is equal to or smaller than 0.05, especially equal to or smaller than 0.04. Said ratio is especially at least 0.01.

Figure 5:
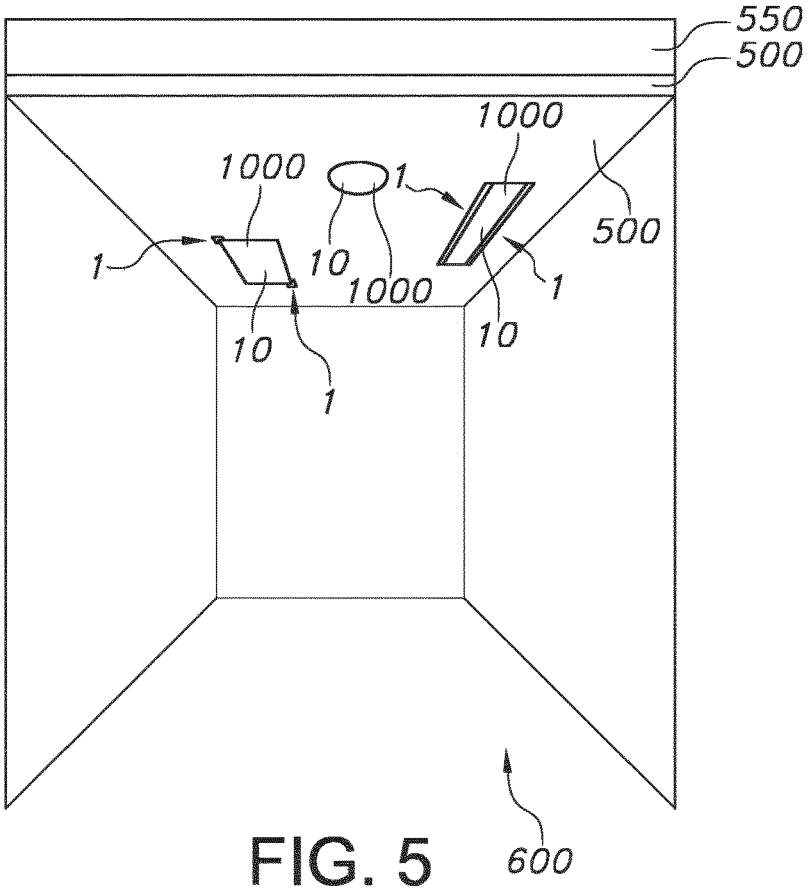
FIG. 5 schematically depicts a space comprising a lighting system of the invention.

In FIG. 5 schematically a space 600 is depicted comprising a lighting system 1000. The lighting system 1000, especially the luminaire 10 may be configured in essentially any space 600 with a (dropped) ceiling 500, such as an office, a department store, a warehouse, a cinema, a church, a theatre, a library. Such dropped ceiling 500 especially comprises a plenum space 550 on top of the ceiling 500. In the figure, three lighting systems 1000, comprising a luminaire 10—in the given embodiment a square luminaire 10, a round luminaire 10 and a rectangular luminaire 10—are mounted in the ceiling 500. For mounting the (square and the rectangular) lighting systems 1000 comprising respectively the square and the rectangular luminaire 10, two fixture elements 1 are used. In the square lighting system 1000, two triangular shape fixture elements 1 (shown exaggerated in size) are arranged at two opposite corners of the opening 510 (non visible) and hence of the luminaire 10. The rectangular lighting system 1000 comprises two fixture elements 1 comprising a T-bar profile arranged along two opposite edges of the opening 510 (not visible any more). In the round lighting system 1000, the fixture elements 1 are covered by the luminaire 10.

Especially, any action described herein may be executed with a man-made device. For instance, a term "sensing" may refer to sensing with a sensor, or a term like "determining" may refer to determining with a processor.

The term "substantially" herein, such as "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

Herein the invention is explained based on mounting a luminaire. It however, will be understood that the invention also provide comprises mounting of other type of applications in a ceiling, such as a heater or an air inlet or retour system that are known to be mounted in a modular ceiling. Hence the term "luminaire" may also be understood as a mountable application in a, especially, modular ceiling.

The invention claimed is:

1. A fixture element for mounting a luminaire at least partly in an opening of a ceiling, wherein the fixture element comprises (i) a body, (ii) a first side portion protruding relative to the body at a first side of the body and configured to support the luminaire, (iii) a second side portion protruding relative to the body at a second side of the body, and (iv) an engagement element resiliently connected to the second side of the body and configured to clamp a part of the ceiling between the engagement element and the second side portion, wherein the first side portion comprises a first connector element for engaging a second connector element of a mounting plate comprised by the luminaire.

2. The fixture element according to claim 1, wherein the engagement element comprises a spring-loaded engagement element.

3. The fixture element according to claim 1, wherein the fixture element comprises a shape configured to mate a part of a shape of an opening wall of the opening in the ceiling.

4. The fixture element according to claim 1, comprising at least two engagement elements and wherein the body comprises a first planar segment and a second planar segment, wherein the first segment and the second segment are configured at a segment angle ($\alpha$) selected in the range of 60-120°, and wherein a first engagement element is connected to the first segment and a second engagement element is connected to the second segment, with the engagement elements configured to clamp parts of the ceiling between the engagement elements and the second side portions, respectively.

5. The fixture element according to claim 4, wherein the segment angle ($\alpha$) is a right angle.

6. The fixture element according to claim 1, wherein the first side portion comprises a plastic material.

7. The fixture element according to claim 1, wherein the first side portion comprises a flat first side portion configured to support the luminaire.

8. A kit of parts comprising a plurality of fixture elements according to claim 1 and a plurality of mounting plates for a luminaire, wherein each mounting plate comprises a second connector element configured to engage a first connector element of the fixture element, wherein each mounting plate is configured connectable to the luminaire, wherein one or more of the fixture elements and the mounting plates comprise a flexible material.

9. The kit of parts according to claim 8, wherein (a) the first connector element comprises a groove and the second connector element comprises a mounting ridge or (b) wherein the first connector element comprises a mounting ridge and the second connector element comprises a groove, for a male-female connection, and wherein the fixture elements and/or the mounting plates comprise a plastic material.

10. The kit of parts according to claim 8, wherein the first connector element of each fixture element comprises a fixture element ridge, with a groove configured between the body and the fixture element ridge, wherein the second connector element of each mounting plate comprises a mounting ridge, wherein each fixture element ridge comprises a fixture ridge angle ($\beta$) and each mounting ridge comprises a mounting ridge angle ($\gamma$), wherein at least one of the fixture ridge angle ($\beta$) and the mounting ridge angle ($\gamma$) comprises an acute angle.

11. A method for mounting a luminaire at a ceiling comprising: (i) providing an opening with an opening wall in the ceiling; (ii) providing at least two fixture elements according to claim 1 to the ceiling by arranging a part of the ceiling between the engagement element and the second side portion; and (ii) a mounting stage comprising configuring the luminaire at least partly in the opening of the ceiling wherein the luminaire is supported by the first side portions.

12. The method according to claim 11, wherein the fixture elements are provided to the ceiling at two opposite corners of the opening, wherein the luminaire comprises a plurality of mounting plates associated to a first side of the luminaire wherein the mounting plates are connected at two opposite edges of the first side of the luminaire, and wherein the mounting stage comprises configuring the first side portions and the mounting plates in a male-female configuration for support of the mounting plates by the first side portions.

13. The method according to claim 12, wherein the mounting stage comprises contacting the second connector element of each mounting plate with the first connector element of one of the first side portions and twisting the luminaire over a twisting angle ($\omega$) selected in the range of 0.5-2.5° to configure the first side portion and the mounting plates in a male-female configuration.

14. A space comprising a lighting system, wherein the space comprises a ceiling and a luminaire mounted in the ceiling, wherein for mounting the luminaire in the ceiling the lighting system comprises at least two fixture elements according to claim 1 and optionally at least two mounting plates.

* * * * *